United States Patent [19]

Murphy

[11] Patent Number: 4,700,624

[45] Date of Patent: Oct. 20, 1987

[54] DIE TRANSFER SYSTEM

[76] Inventor: William P. Murphy, 1067 Kennesaw Ave., Birmingham, Mich. 48008

[21] Appl. No.: 884,077

[22] Filed: Jul. 10, 1986

[51] Int. Cl.[4] ..... B30B 15/02

[52] U.S. Cl. ..... 100/224; 72/448; 100/918; 193/35 SS; 414/531

[58] Field of Search ..... 100/221, 224, 229 R, 100/918; 193/35 SS; 414/531, 532, 533; 72/448

[56] References Cited

U.S. PATENT DOCUMENTS

| | | | |
|---|---|---|---|
| 282,588 | 8/1883 | Thomas | 100/229 R X |
| 3,318,232 | 5/1967 | Barton | 100/229 R X |
| 4,317,358 | 3/1982 | Yonezawa | 100/229 R X |
| 4,498,384 | 2/1985 | Murphy | 100/224 |

FOREIGN PATENT DOCUMENTS

| | | | |
|---|---|---|---|
| 2383010 | 11/1978 | France | 100/229 A |

*Primary Examiner*—Peter Feldman
*Attorney, Agent, or Firm*—Lyman R. Lyon

[57] ABSTRACT

A die transfer system comprises a pair of elongated, horizontally extending vertically movable rails having a plurality of rollers thereon. A pair of elastomeric elements have a vertical dimension and elastic coefficient such that the rolls on said rails are elevated above an upper surface of said bolster to a die transfer condition. Biasing of said die toward said bolster effects deflection of said elastomeric elements. Release of said biasing means permits elevation of said rails, rollers and die to said die transfer condition due to elastic memory of said elements.

1 Claim, 5 Drawing Figures

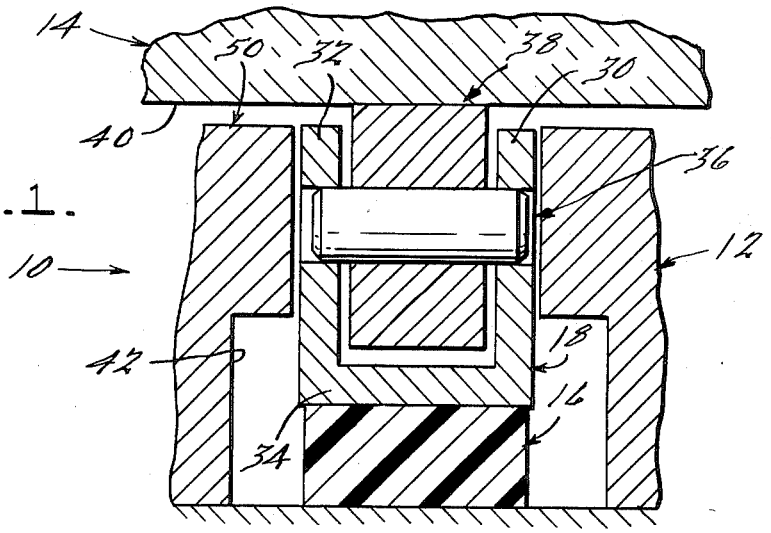
FIG. 1.
FIG. 2.
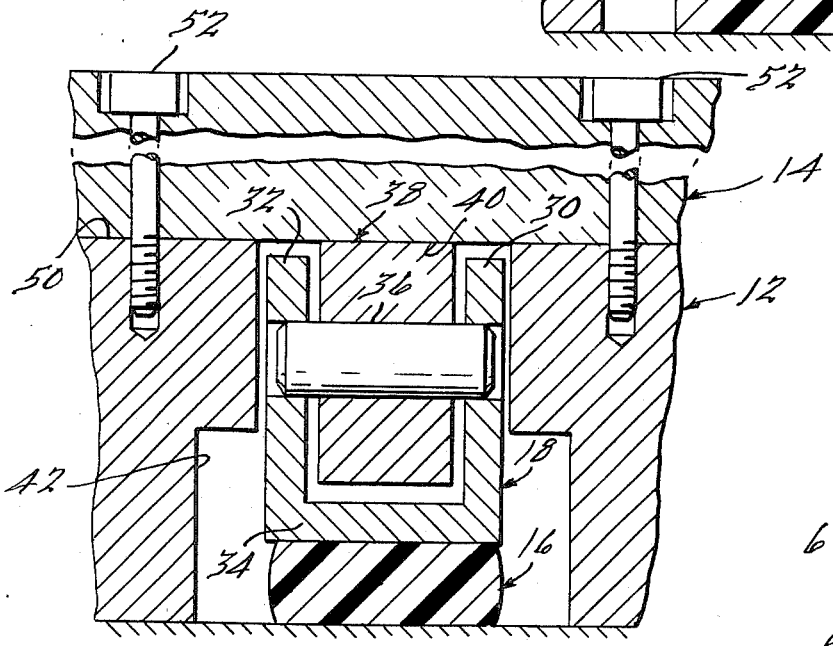
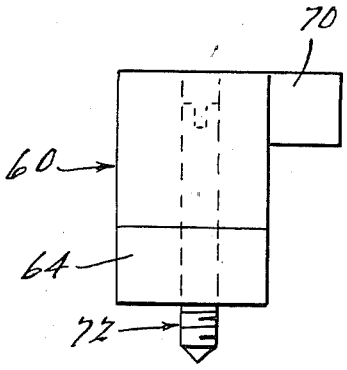
FIG. 5.
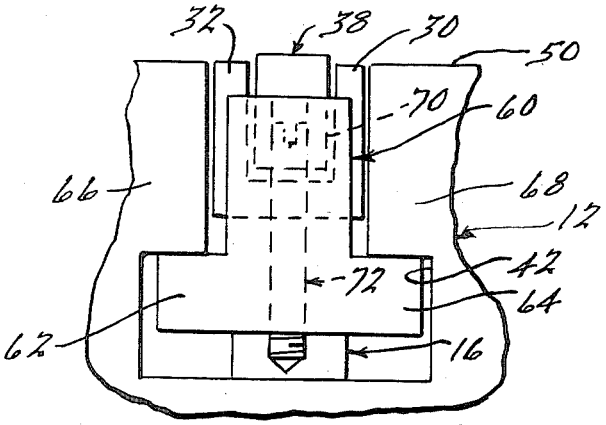
FIG. 3.
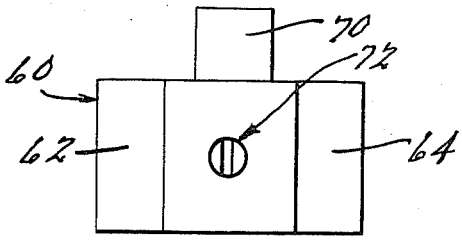
FIG. 4

DIE TRANSFER SYSTEM

BACKGROUND OF THE INVENTION

Relatively heavy stamping and injection molding dies present a handling problem when such dies are assembled with or removed from the bolster of a press. The problem is complicated by the fact that the press generally has a ram or other superstructure mounted directly over the die support bolster precluding vertical lift of the die or die set by a conventional crane. Movement of a die set laterally with respect to the bolster of such presses has heretofore required relatively complex and fragile systems that are not compatible with the duty cycle of such presses.

SUMMARY OF THE INVENTION

The die transfer system of the instant invention is relatively rugged and simple in construction and constitutes an improvement on the system disclosed in my U.S. Pat. No. 4,498,384. As disclosed in said Letters Patent, a plurality of rollers are orientated in spaced, parallel relation and are elevatable above the upper surface of the bolster of the press. Heretofore, the rollers have been elevated by hydraulic, pneumatic, or mechanical system.

In accordance with the present invention, the rollers are mounted in rails which are elevated by the elastic memory of urethane spring blocks disposed under each rail. The rails are elevated upon release of conventional die holddown screws or T-slot bolts. The degree of elevation of each rail is dictated by the original height and memory of the urethane spring blocks.

BRIEF DESCRIPTION OF THE DRAWINGS

FIG. 1 is a fragmentary cross-sectional view of a press bolster incorporating the urethane spring block die transfer system of the instant invention with the rails and rolls thereof in the elevated condition;

FIG. 2 is a view similar to FIG. 1 after deflection of the urethane spring blocks;

FIG. 3 is an end view of a T-slot showing a rail clamp mounted therein;

FIG. 4 is a top view of the clamp of FIG. 3; and

FIG. 5 is a side elevational view of the end clamp of FIG. 4.

DETAILED DESCRIPTION OF THE PREFERRED EMBODIMENT OF THE INVENTION

As seen in FIG. 1 of the drawings, a die transfer system 10, in accordance with a constructed embodiment of the instant invention, is mounted in a heavy duty press bolster 12 to facilitate movement of die 14 on and off the press bolster 12.

In accordance with the instant invention, the transfer system 10 comprises a urethane block 16 that underlies a U-shaped rail 18. The rail 18 comprises a pair of vertical legs 30 and 32 that are connected by a bight portion 34. The rail 18 supports a plurality of roller shafts 36 each of which journals a roller 38. The rollers 38 are in constant engagement with a bottom surface 40 of the die 14.

In practice, the rail 18 is set into a conventional "T"-slot 42 in the bolster 12. Use of the T-slot 42 permits the use of conventional clearances, stroke, and die set heights.

Operation of the die transfer system 10 is best visualized by noting that, as seen in FIG. 1, the urethane spring 16 in the normal condition effects elevation of the rollers 38, and die 14 above an upper surface 50 of the bolster 12.

As seen in FIG. 2, deflection of the urethane spring 16 is achieved by tightening a plurality of die holddown screws 52 thereby to bias the rail 18 downwardly against the spring 16. Such deflection results in lowering of the rail 18 to a position wherein the upper surface of each roll 38 is disposed at the level of the surface 50 of the bolster 12 permitting the die 14 to rest thereupon.

When the screws 52 are released, a die lift force is provided by the urethane spring block 16, which, in a constructed embodiment, runs the entire length of the lift rail 18. The shape of this spring block 16, i.e., its height and width, determines the lift force under the rail 18. For example, lift forces of 1800#, 2600#, 3600# or 4200# per foot of length can be selectively achieved. When fully elevated, the rollers 38 are exposed approximately $\frac{1}{8}''$ above the surface 50 of the bolster 12.

As seen in FIG. 3, a rail end clamp 60 is provided to complete the die transfer system 10. The clamp 60 comprises a pair of laterally extending flanges 62 and 64 which underlie inwardly extending flanges 66 and 68 of the T-slot 42 in the bolster 12. A rail retention ear 70 overlies the bight portion 34 of the rail 18. When a set screw 72 is advanced against the bottom of the T-slot 42, the flanges 62 and 64 are biased upwardly against the flanges 66 and 68 locking the clamp 60 in the T-slot 42. Thus, the rail 18 is precluded from excessive upward movement relative to the T-slot 42 and is longitudinally retained therein.

The versatility of the die lift system of the instant invention can best be shown by two examples:

(a) In a shop situation wherein a press has a bolster dimension of 6′ and die weight of 50,000# to 70,000#, three rails 18 with a lift capacity of 4200#/ft. are employed. Thus, a lift force of 25,000# per rail is achieved for total lift of 75,000# rolling capacity.

(b) In a second example, a press has a bolster dimension of 3′, with die weights of 8000# to 10,000# which requires two 36″ rails 18 having a lift capacity of 1800#/ft. A lift force of 5400# per rail is achieved for total of 10,800# rolling capacity.

From the foregoing description it should be apparent that the die transfer system of the instant invention is inexpensive, effective and eliminates potential failure due to hydraulic, air or electrical failure.

While the preferred embodiment of the invention has been disclosed, it should be appreciated that the invention is susceptible of modification without departing from the scope of the following claims.

I claim:

1. A die transfer system for a press comprising a bolster having a horizontal die support surface with a slot therein having a horizontal bottom surface, said die transfer system comprising an elongated, horizontally extending vertically movable rail disposed in the slot in said press bolster, said rail having a horizontal bottom surface, a roller on said rail for directly supporting a die, a solid elastomeric spring element having a horizontal upper surface engageable with the bottom surface of said rail and a horizontal lower surface engageable with the bottom surface of said slot, said elastomeric spring element having a vertical dimension, durometer and elastic memory coefficient such that a die supported on the roll of said rail is normally biased to a die transfer condition above the die support surface of said bolster, and means for biasing said die downwardly into engagement with said bolster so as to subject said elastomeric spring element solely to vertical compression while maintaining the upper and lower surfaces thereof in parallel relation, release of said biasing means effecting elevation of said rail, rollers and die to said die transfer condition due solely to elastic memory of said element.

* * * * *